United States Patent [19]

Morey

[11] 4,391,205

[45] Jul. 5, 1983

[54] METHOD AND APPARATUS FOR BURNING GREEN WOOD CHIPS

[76] Inventor: Norval K. Morey, Box 97, Winn, Mich. 48896

[21] Appl. No.: 231,947

[22] Filed: Feb. 6, 1981

[51] Int. Cl.[3] ..... F23G 5/04

[52] U.S. Cl. ..... 110/224; 110/204; 110/228; 110/255; 110/251; 110/256

[58] Field of Search ..... 110/102, 251, 276, 219, 110/224, 227, 228, 255, 256, 204, 344, 346, 347

[56] References Cited

U.S. PATENT DOCUMENTS

| | | | |
|---|---|---|---|
| 178,372 | 6/1876 | Kidder | 110/251 |
| 2,292,571 | 8/1942 | Komline | 110/224 |
| 3,027,854 | 4/1962 | Akerlund | 110/228 |
| 3,412,696 | 11/1968 | Ehrenzeller et al. | 110/204 |
| 3,863,577 | 2/1975 | Steever et al. | 110/255 |
| 4,030,895 | 6/1977 | Caughey | 110/224 |
| 4,098,200 | 7/1978 | Dauvergne | 110/204 |
| 4,167,909 | 9/1979 | Dauvergne | 110/228 |
| 4,278,034 | 7/1981 | Reale | 110/251 |
| 4,281,603 | 8/1981 | Probsteder | 110/255 |

*Primary Examiner*—Henry C. Yuen

*Attorney, Agent, or Firm*—Learman & McCulloch

[57] ABSTRACT

Apparatus and method for burning green wood chips in which the hot combustion gases generated by the burning of the chips in a furnace are passed through chips in a storage silo from which the chips are subsequently fed to the furnace. A column of chips of substantial height is maintained in a top vented silo. Chips are fed from the lower portion of the column to the furnace and usually mixed with other fuel such as particulate coal or coal dust, and the hot combustion gases from this combustion are fed into the silo at a location substantially below the top of the column of chips so that the gases permeate and pass upwardly through the column of chips to dry them. The chips also act as a filter to remove environmental contaminants from the gases.

5 Claims, 1 Drawing Figure

METHOD AND APPARATUS FOR BURNING GREEN WOOD CHIPS

BACKGROUND OF THE INVENTION

Figure 1:
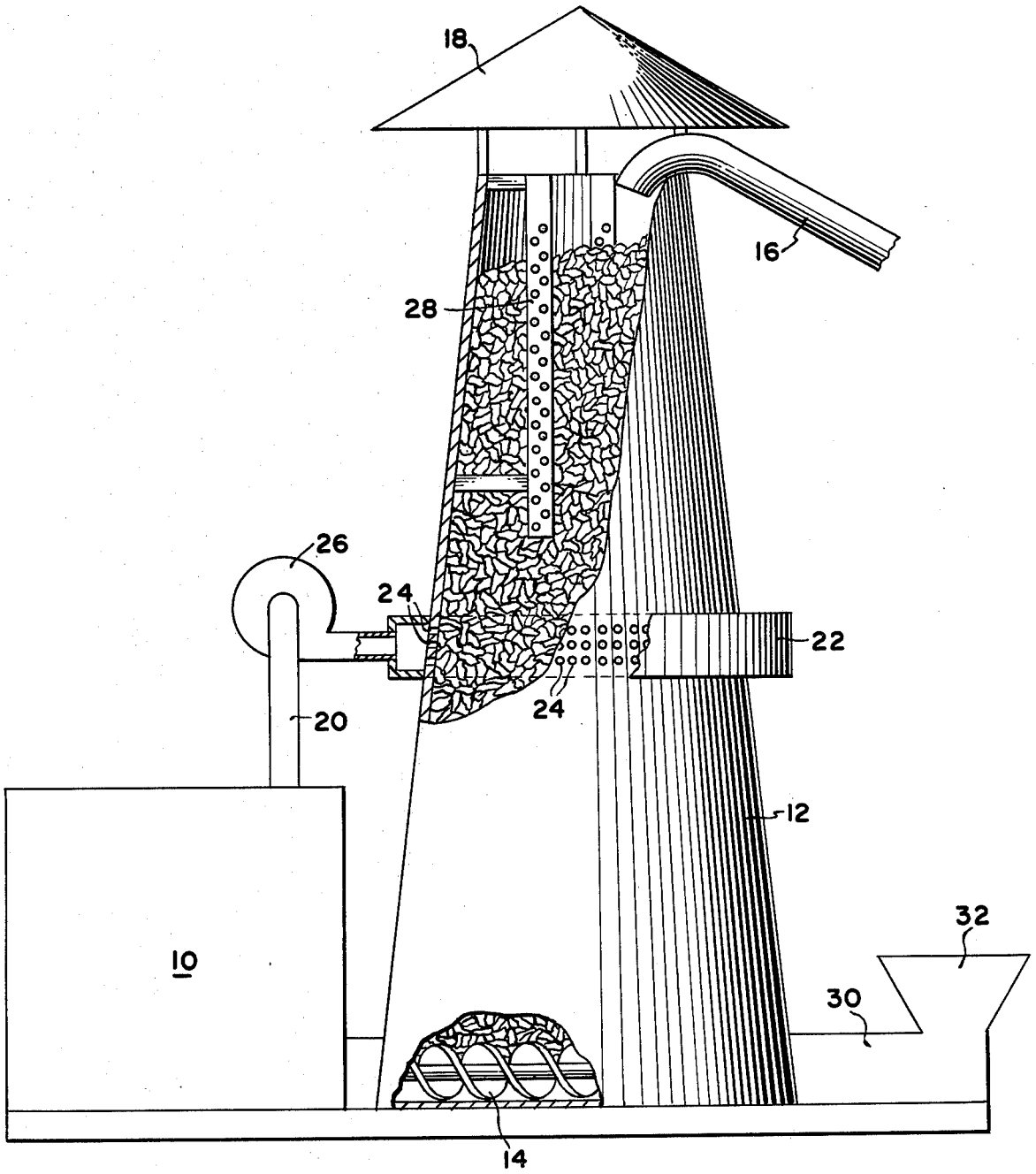

In 1970, the assignee of the present application developed and placed on the market a machine operable to swiftly and efficiently reduce whole trees, with limbs and branches attached, to wood chips. See U.S. Pat. No. 3,661,333. Although developed with other purposes in mind, it soon became apparent that this particular machine made feasible, for the first time, selective thinning programs for large areas of forests over-grown with scrub and unmerchantible trees which were choking out or hindering the growth of pines, hardwoods and other desirable timber. Previously, selective thinning of such forests on any reasonable scale was difficult or economically impractical because of the problem of disposing of the brush and other trees felled during the thinning process.

This problem was solved by the machine of U.S. Pat. No. 3,661,333—that machine reduced this scrub and felled trees swiftly to wood chips and in the process blew the chips into vans which could be used to transport the chips out of the immediate area. The chips so produced were used as mulch or, after suitable separating processes, found some commercial usage in paper-making or particle board making operations. However, the potential supply of wood chips from such selective thinning operations far exceeded the commercial demand for such chips.

It was then proposed that such chips would constitute an excellent source of fuel. The trees from which the chips were produced represented a self-replenishing source in that the species removed during the selective thinning operation, of which, aspen is a typical example, re-establish themselves quite rapidly. The species sacrificed in the selected thinning operation have little economic or ecological value. In view of the oil crisis, these facts suggested that wood chips might well be employed as a fuel for electric power generating plants.

Investigations have led to the conclusion that there are many areas in the United States where sufficient undesirable and unmerchantible trees fluorish to the point where selective thinning programs would produce a sufficient quantity of wood chips to provide a permanent source of supply of fuel to operate an electrical generating plant adequate to meet the needs of a small town and that this source would regenerate itself at a rate exceeding the rate of consumption.

One problem addressed by the present invention is the fact that substantially all of the wood chips produced in a selective thinning operation of the type referred to above are produced from green wood—that is from living trees whose wood contains a substantial amount of moisture. Green chips do not burn as readily as dry chips. Because the green chips typically are produced in very large quantities, outdoor storage in large piles is the only practical method, and such storage is not conducive to the drying of the chips, particularly those in the interior of the pile. Another problem addressed is that of the release of contaminants in the flue gas when the chips are burned alone or as part of a fuel mix.

In accordance with the present invention, hot combustion gases created by the burning of chips are employed to heat, and thus dry, subsequent chips as they are being fed to the furnace and the chips are simultaneously used to filter out contaminants.

SUMMARY OF THE INVENTION

In accordance with the present invention, a silo is located next to the furnace to maintain a supply of chips in a vertical column of substantial height. Typically, the silo may be twenty feet in diameter, and sixty feet high. Chips are fed from the bottom of the silo into the furnace; fresh chips are fed into the top of the silo to replenish chips withdrawn from the bottom to maintain the column of chips in the silo at a substantially constant height. The combustion gases from the furnace are fed into the silo at a point substantially below the top of the column of chips in the silo (typically about one third to one half of the way up the column of chips) so that the hot combustion gases must flow upwardly through the chips before they are vented from a stack at the top of the silo. The passage of these hot gases through the chips drys the chips.

Further, the chips not only absorb heat from the gas to reduce the temperature of the discharged gases, but the bed of chips through which the gases pass acts as a filter to filter solid particles and contaminants such as sulphurous vapors and the like in those cases where the furnace is supplied with a wood chip—coal dust mixture. Further the heat extracted in the drying of the bed of chips reduces the temperature of the stack gases substantially during their upward passage through the column of chips. The solid particles and contaminants captured by the chips are carried by the chips back into the furnace where they are eventually removed as clinker.

Other objects and features of the invention will become apparent by reference to the following specification and to the drawing.

IN THE DRAWING

FIG. 1 is a side elevational view, with certain parts broken away or shown in section of a chip burning apparatus embodying the present invention.

In the drawing, a wood chip fired boiler or furnace is indicated generally at 10 located closely adjacent a chip containing silo 12. Silo 12 is substantially filled with a supply of wood chips, confining the wood chips in a column of a substantial height. A suitable conveying means, such as a screw conveyor 14 extends through the bottom of the silo to convey wood chips from the silo into the furnace 10.

The silo preferably is of a tapered frustoconical shape so that gravitational feed of the wood chips occurs without the bridging problems sometimes encountered in vertical walled silos. The column of wood chips maintained within silo 12 is maintained at a substantially constant height by adding fresh chips to the top of the column within silo 12 as by blowing the chips through the spout of a chip blower partially indicated at 16, to replace chips withdrawn from the bottom of the column by conveyor 14.

Silo 12 is open at its top, a conical cap 18 being mounted above the open top of the silo to keep rain from entering the silo interior.

Hot combustion gases generated by the operation of furnace 10 pass from a flue 20 into an annular manifold chamber 22 which extends around the circumference of silo 12, that portion of the silo wall enclosed by manifold 22 being perforated as at 24 so that combustion gases pass from the manifold chamber into the interior of the silo via perforations 24. Because the interior of silo 12 is filled with wood chips for a substantial distance above the band of perforations 24, in the usual case a blower 26 will be employed to force the combustion gases under pressure into mount the chamber of manifold 22. Hot combustion gases passing into the interior of the silo through perforations 24 pass upwardly through the wood chips to be vented through the open top of silo 12.

During the passage of the gases through the upper portion of the stack of chips contained in silo 12, the hot gases extract moisture from the chips to dry them. In addition to the drying of the chips by the passage of the combustion gases through the chips, the substantial column of chips through which the gases must filter before they are vented from the silo finds the chips acting as a filter bed which effectively removes all solid particles from the combustion gases and, because of the porosity of the chips, some contaminate type gases will be absorbed by or condensed upon the chips, thus resulting in a relatively clean smoke emission from the system. Further, the drying process extracts a substantial amount of heat from the combustion gases. Flue gases entering manifold 22 at a temperature of approximately 600° F. may be cooled to approximately 100° to 150° F. by the time the gases are emitted from the top of silo 12.

In some cases, particularly where the column of wood chips extends to a substantial height above the point at which the combustion gases are introduced into the interior of the silo, the mass of chips may be so great as to overly restrict the draft drawing gases out of the top of the stack. In such a case, a suitable number of perforated draft tubes 28 may be mounted in the upper silo interior to extend from a point above the point of entry of the gases into the silo to a point above the top of the column of chips, the draft tubes 28 thus serving to maintain a reasonable rate of flow of combustion gases through the upper portion of the silo.

It will usually be found desirable to mix another combustible material, such as coal, coal dust, oil, etc. with the wood chips to further improve the combustion within furnace 10. Such additional combustible material may be introduced by extending the feeding means 14 as at 29 and providing a hopper or other suitable inlet as at 30 to introduce the additional combustible material into feed screw 14 for mixture with the wood chips as they are conveyed to the furnace. The proportions of such mixture will vary widely depending upon the particular assisting combustible material which is employed and the nature of the overall operation.

For example, assuming that the additional combustible material is coal, it may be desirable to feed in a relatively high proportion of coal during the initial charging and lighting off of furnace 10 and to subsequently reduce the proportion of coal after the operation has proceeded to a point where wood chips dried by the hot cobustion gases begin to reach feeder 14. Thus, in general, where an additional combustible material is mixed with the wood chips, the proportions of wood chips to additional combustible material normally will be from between 25% and 75% wood chips by volume. Because the wood chips are porous and cellular, they act as sponges to collect pollutives such as fly ash, sulferous compounds, and the organic and inorganic products of incomplete combustion, and enable materials such as coal, municipal waste and garbage, and the like, to be burned and meet emission standards without utilizing costly permanent flat scrubber elements which require periodic cleaning. With the present process and apparatus, the flue gases exiting should comprise virtually only steam.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. Apparatus for burning wood chips comprising a wood chips combusting furnace with an exhaust conduit communicating therewith and leading out of said furnace, a top vented vertically extending silo, separate from said furnace to prevent combustion of its contents but adjacent thereto, filled with a stack of porous cellular wood chips to provide a silo-encased continuous vertical chip column of substantial height, feed means for feeding wood chips from the lower end of said stack to said furnace, supply means for supplying moisture laden wood chips to the upper end of said silo to replenish chips withdrawn from said silo by said feed means, and manifold means on said silo to which said exhaust conduit leads communicating with the exhaust conduit of said furnace for peripherally discharging combustion gases from said furnace into the periphery of the stack of chips in said silo at a location below the top of said stack of chips contained therein to dry the chips in the upper portion of said stack as said gases pass upwardly therethrough to be vented from the top of said silo and to filter contaminants from said gases, said manifold means comprising a manifold band substantially surrounding said silo above the said feed means and substantially below and remote from the said wood chips supply means, there being perforations in the wall of said silo at said band placing the interior of said silo in communication with said manifold whereby combustion gases pass from said manifold into said stack perimetrally through said perforations.

2. The invention defined in claim 1 wherein a blower is provided for inducing a flow of said gases from said furnace into said band and stack.

3. The invention defined in claim 1 wherein said feed means comprises means for mixing another combustible material with said wood chips as said chips are fed to said furnace.

4. The invention defined in claim 3 wherein said means for mixing is operable to feed to the furnace a mixture of wood chips and other combustible material consisting of between 25% and 75% of wood chips by volume.

5. The invention defined in claim 1 in which at least one perforated, vertically disposed internal draft enhancing tube is mounted by said silo within said chip column to extend vertically through a portion of said chip column at a location spaced radially inwardly from the perimeter of the chip column from an elevation above said chip stack to a location vertically spaced from said manifold, said draft tube being vertically perforated over a substantial vertical distance thereof to receive flue gases from said manifold via said chip stack.

* * * * *